United States Patent [19]

Urschel

[11] 3,989,196

[45] Nov. 2, 1976

[54] CUTTER HEAD

[76] Inventor: Joe R. Urschel, 202 Michigan, Valparaiso, Ind. 46383

[22] Filed: Apr. 9, 1975

[21] Appl. No.: 566,257

[52] U.S. Cl. ..... 241/27; 241/88.1; 241/299

[51] Int. Cl.[2] ..... B02C 13/282

[58] Field of Search ..... 241/27, 86, 86.1, 88.1, 241/88.4, 95, 299

[56] References Cited

UNITED STATES PATENTS

| | | | |
|---|---|---|---|
| 1,439,754 | 12/1922 | Plaisted | 241/88.1 |
| 2,938,558 | 5/1960 | Urschel | 241/88.1 |
| 3,196,916 | 7/1965 | Urschel | 241/86.1 |
| 3,251,389 | 5/1966 | Urschel et al. | 241/88.1 X |

*Primary Examiner*—Granville Y. Custer, Jr.

[57] ABSTRACT

The subject invention involves providing a cast tubular cylindrical cutter head having wall structure provided with openings and inner cutting edges for use with an impeller adapted for rotation therein for directing a product against the edges for cutting the product into pieces for discharge outwardly through the openings, and surfaces or faces which extend outwardly to define the openings are disposed in a unique divergent relationship whereby to promote or facilitate the flow or discharge of the cut product therethrough.

17 Claims, 8 Drawing Figures

CUTTER HEAD

BACKGROUND OF THE INVENTION

In order to obtain a better understanding of the subject invention the following data is submitted for the purpose of comparing its attributes, for example, with various types of cutter heads, manufactured and sold by the Urschel Laboratories Inc. of Valparaiso, Ind. which are exemplified in certain earlier Patents:

Cutting heads have heretofore been made by what may be referred to as a method A are described in U.S. Pat. No. 2,938,558 issued May 31, 1960. The cutting heads in this Patent were machined from a solid piece of steel. Various types of configurations are described in the Patent and all of them produced too much friction on the product being cut which resulted in excessive heat produced in the product. When cutting meat with such cutting heads, the fat portion of the meat was smeared over the lean portion resulting in a product with poor appearance. Excessive amounts of time was also required to machine these cutting heads which resulted in a high cost and a resulting high selling price.

Cutting heads made by what may be termed a method B are described in U.S. Pat. No. 2,875,800 issued Mar. 3, 1959. The heads in this Patent were made up of flat circular rings and flat rectangular knives. The various parts were held together with bolts. From a practical consideration, it would have been extremely difficult to make these to cut a product into small flakes. The reason for this is that too many parts would have been required and these parts would be so thin in cross section that the parts would be easily bent and broken in use. The cost of making the many parts would be too high resulting in a high price for the assembled cutting heads.

Cutting heads made by a method termed C are described in U.S. Pat. Nos. 3,196,916 issued July 27, 1965 and No. 3,255,646 issued June 14, 1966. The cutting heads shown in these Patents are made up of segments which are stamped out on a punch press, they are then stacked and held together with rivets while being welded together in a furnace. These cutting heads have been successfully manufactured over a period of years and are highly suitable for a large number of applications. There are, however, several disadvantages to making cutting heads by this method. Since there are as many as 4,000 segments in certain cutting heads, the cost of stacking the segments is high. Some desirable metal alloys with suitable hardness and wear resistance cannot be stamped on a punch press without breaking the segments into pieces. There is no practical way to place a taper on the surfaces of the segments. Because of this, the cut product must be ejected from the cutting head through passages having parallel surfaces. Rather than having the cut pieces of product ejected in free flight the product jams between the parallel surfaces and the product is extruded in a compressed form from the cutting head. This is turn causes excessive power to be used resulting in appreciable heating of the product being cut, smearing the surface of the cut product and crushing the tissue of the cut product.

Cutting heads made by an improved method are described in the subject application. By utilizing this improved method, the three disadvantages inherent in the cutter heads alluded to above are overcome. The present method used is to cast the cutting head in one piece by use of investment casting. The cutting heads are cast from hard, stainless materials. Although other methods may be used for making these precision castings, investment casting seems to be the only practical method at this time. After the castings are made, very little work is required to finish them. It is only necessary to grind the top and bottom of the cutting heads to make them flat and parallel and then to grind an internal cylindrical surface to sharpen the internal knives or cutting edges. Investment casting is a casting method designed to achieve high dimensional accuracy by making a mold of refractory slurry, which sets at room temperature, surrounding a wax pattern which is then melted out to leave a mold without joints. In making the cutting heads, the mold is heated to about 1,800° F and metal is poured into it at about 2,800° F. The wax patterns are made by injecting hot wax under pressure into a cavity fixture. The fixture is composed of several pieces of metal. There is a top and bottom plate, a central core and a number of pieces to form the outside configuration of the wax pattern cutting head.

OBJECTIVES

With the foregoing in mind it should be manifest that a significant object of the invention is to provide a tubular cylindrical cast cutter head having wall structure comprised of a plurality of circumferentially spaced longitudinally extending posts or columns and a plurality of longitudinally spaced circumferentially and outwardly extending bars, partitions, or members which divide the spacings between the posts into longitudinal rows of substantially corresponding discharge openings, the letter of which are so constructed that the flakes or pieces of product cut by cutting edges provided on the interior of the head will flow freely outwardly whereby to substantially alleviate jamming or clogging of the openings and thereby reduce the factors of friction and heat.

More particularly, an objective of the invention is to provide an organization in which the posts have adjacent opposed outwardly extending divergent surfaces which define the sides of the discharge openings and the bars or partitions have, adjacent opposed outwardly extending divergent surfaces which define what may be termed ends of the openings so that the openings may be said to taper or diverge outwardly or have outer cross-dimensions which are greater than inner cross-dimensions thereof. It may also be stated that each bar or partition has planar surfaces which taper or converge outwardly.

An important object of the invention resides in providing a cutter head in which the portions thereof which are important to its use can be more accurately or correctly dimensioned as compared to prior cutter heads described above the respect to methods A, B and C, thereby resulting in a more efficient productive use and a more uniform resultant product.

An important object of the invention is to provide an improved cutter head in which the bars or partitions thereof have inner portions which are preferably respectively interrupted with notches or teeth whereby to provide grooves in the product and the cutting edges will cut the grooved portion into pieces which are substantially uniform as to size, appearance and texture.

Another object of the invention is to provide a cast head of superior structure which offers advantages with respect to cleanliness, durability and reduction in cost of manufacture as compared to some of the cutter heads above referred to.

Additional objects and advantages of the invention will become apparent after the description hereinafter set forth is considered in conjunction with the drawings annexed hereto.

DRAWINGS

DESCRIPTION

Figure 1:
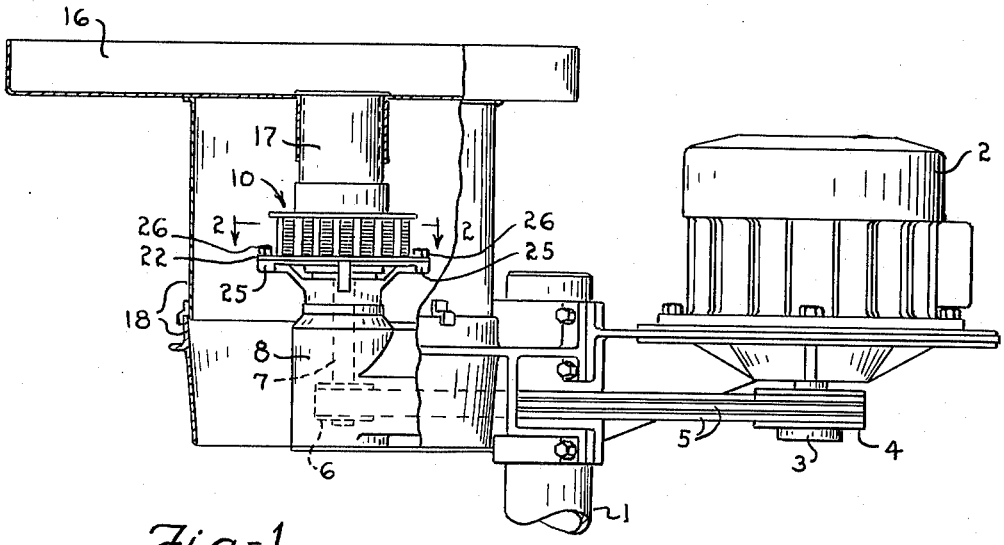
FIG. 1 is a partial elevational view of a machine embodying the invention with portions of the machine being broken away to illustrate the location of the cutter head and certain components operatively associated therewith.
Figure 2:
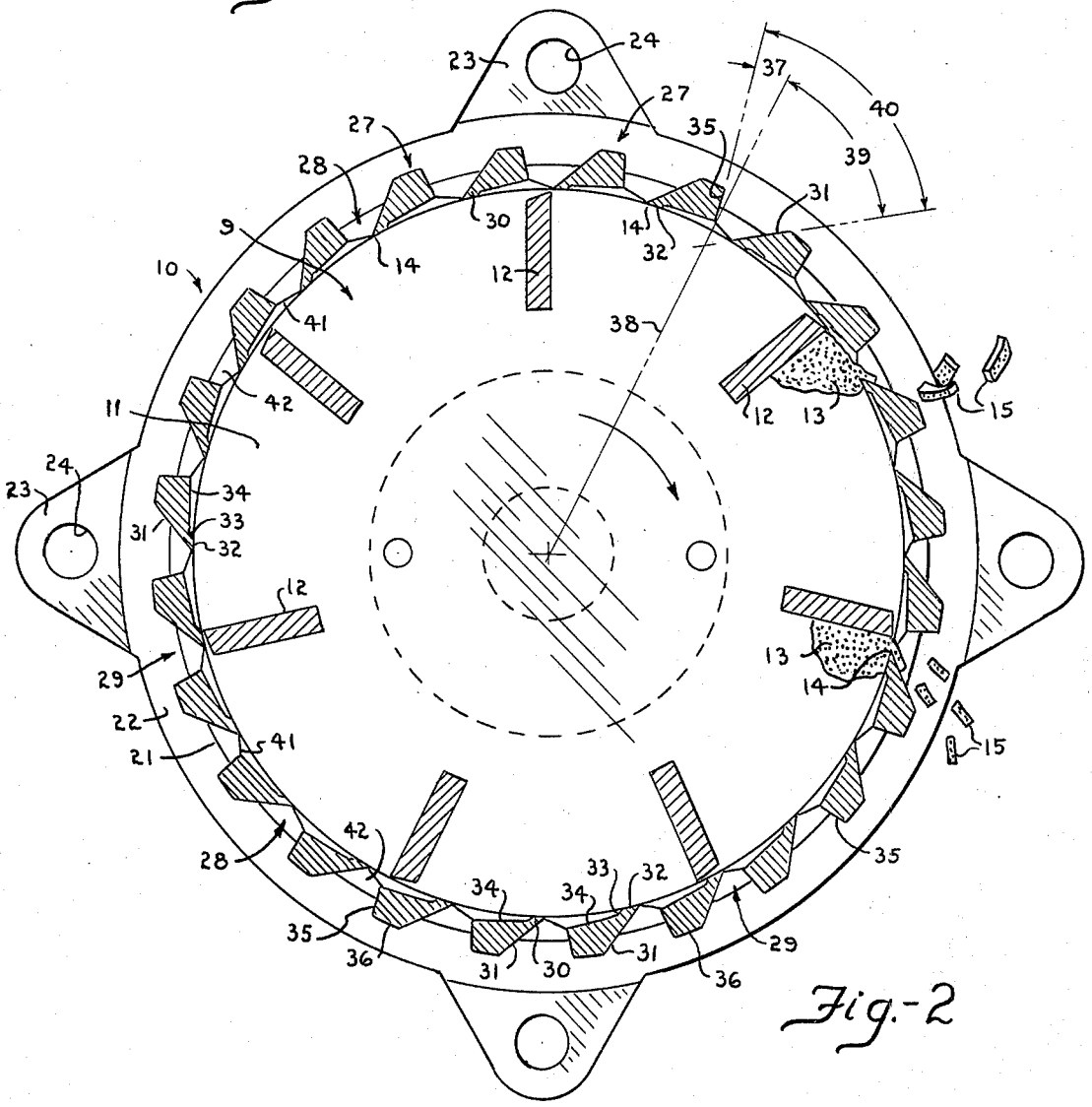
FIG. 2 is an enlarged transverse section taken substantially on line 2 — 2 of FIG. 1.

Referring first to FIGS. 1 and 2, there is disclosed, among other things, a pillar 1 which supports a motor 2 at one side thereof. The motor is provided with a drive shaft 3 carrying a pulley 4 which is operatively connected by belts 5 to a pulley 6 of a vertical driven shaft 7 journalled in a bearing of an offset mounting 8 supported on the pillar. The shaft 7 is keyed to an impeller generally designated 9 which is adapted to rotate within the confines of a cutter head generally designated 10 which is adapted for attachment to the mounting means 8. The impeller includes a base wall 11 which is affixed to the driven shaft 7 and circumferentially spaced blades 12 having leading surfaces which serve to direct a product, such as 13, against circumferentially spaced longitudinally extending inner cutting edges 14 provided on the wall structure of the head for cutting the product into pieces or flakes 15.

The machine shown in FIG. 1, also preferably includes what may be termed a hopper tray 16 for supporting a product for passage downwardly through a tubular structure 17 into the cutter head 10 and an external housing or casing structure 18 which surrounds the cutter head for guiding the cut product downwardly into a container not shown.

The cutter head 10, as generally set forth above, is tubular and cylindrical in shape and comprises wall structure having an upper or end annular portion 19 provided with an outwardly extending radial portion or flange 20 and a lower end or generally annular portion 21 which has an outwardly extending radial portion or flange 22 preferably provided with four offset generally triangular formations or ears 23 provided with apertures 24. The portion 21 constitutes a base which is preferably detachably connected to radial arms 25 of the mounting or supporting means 8 by fastening means, such as screws 26, which extend through the apertures 24 into tapped holes provided therefor in the arms for positioning the head in a vertical position for use as depicted in FIG. 1.

More particularly the wall structure of the cutter head primarily comprises a plurality of circumferentially spaced corresponding longitudinally extending posts or columns generally designated 27 and a plurality of longitudinally spaced circumferentially extending bars or partitions generally designated 28 which join or connect the posts together in a manner whereby to provide a plurality of substantially corresponding openings 29 through which the cut pieces of the product are discharged. All of the portions of the cutter head are integrally joined to provide a structure which is stable, durable and substantially dimensionally correct, except for a minimum of machining, since the head is cast in one-piece.

Each of the posts or columns 27 of the head has an inner generally triangular portion 30 which is machined or sharpened to provide the cutting edges 14 above referred to. More specifically, the cutting edges of each post points in a direction opposite to that of the impellers rotation and each cutting edge is defined by converging surfaces 31 and 32. Each post is also provided with an inner surface 33 and an inner surface 34 which define an obtuse angle and are angularly disposed with respect to the surfaces 31 and 32 to provide a clearance or relief area so that the product 13 is substantially prevented from engaging the surfaces 33 and 34 while the product is being cut as evidenced in FIG. 2. Otherwise expressed, the product is rotated at a relatively high speed by the blades 12 of the impeller in a clockwise direction against the cutting edges and as the product is being cut into the pieces 15 the latter will flow substantially tangentially outwardly and avoid engaging the relief surfaces and thereby reduce or appreciably minimize the detrimental factors such as friction, heat and the accumulation of any hard deposits on the surfaces 33 and 34 of the posts. It should be noted that the impeller blades 12 having outer bevelled edges and these edges preferably have an appropriate running clearance with respect to the cutting edges 14.

Attention is directed to the fact that each post or column also has a surface 35 and an outer surface 36 and that the surface 35 is disposed at an acute angle 37 with reference to a radial line 38 and that the surface 31 is also disposed at an acute and larger angle 39 with reference to the radial line 38 than the angle 37 whereby the opposed surfaces 35 and 31 of adjacent posts diverge outwardly to define a still larger angle 40 encompassing the other angles, as shown in FIG. 2. The opposed surfaces 31 and 35 of adjacent posts may be considered to constitute side surfaces or faces of the openings 29.

The bars or partitions 28, above referred to, are longitudinally spaced apart and disposed circumferentially. They may be considered to be generally trapezoidal in shape and have inner straight edge portions 41 forming common planes, which planes are angularly disposed with respect to planes formed by the surfaces 34 to define an obtuse angle and also acute angles with the leading faces of the impeller blades 12. Obviously, the bars may be shaped other than as shown.

Figure 3:
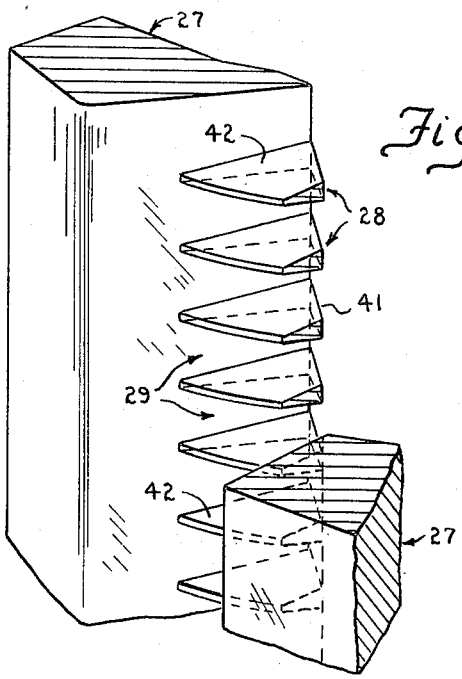
FIG. 3 is an enlarged partial view of a portion of the cutter head depicting structural details thereof.
Figure 4:
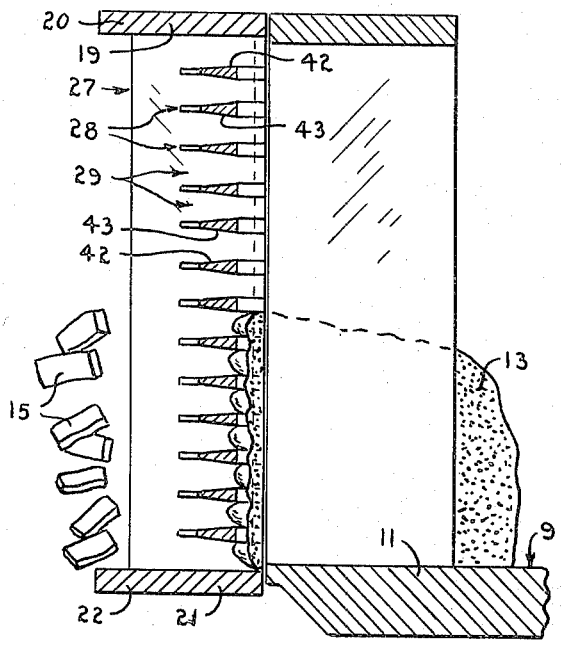
FIG. 4 is an enlarged partial vertical sectional view of the cutter head showing other details.
Figure 5:
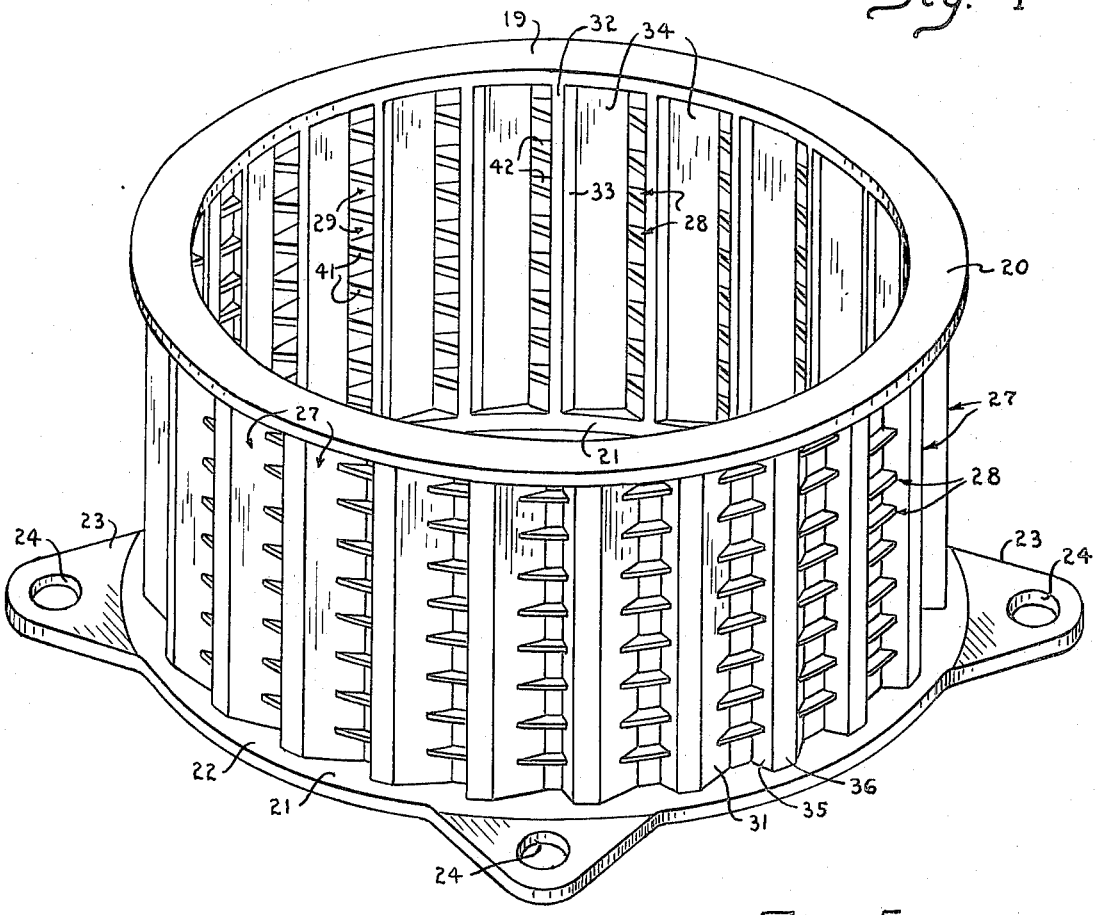
FIG. 5 is a pictorial view of a complete cutter head.

Attention is directed to the significant fact that the bars have upper surfaces 42 and lower surfaces 43 which taper or generally converge outwardly. The inner portions of the bars or partitions thereby have a greater cross-dimension than the outer portions thereof as clearly exemplified in FIGS. 3 and 4. This structure offers a unique setup whereby the opposed tapered surfaces 42 and 43 of adjacent bars diverge outwardly.

These surfaces may be considered to constitute end surfaces or faces of the discharge openings 29. Otherwise expressed, each of the corresponding discharge openings is formed by opposed faces of adjacent bars and opposed faces of adjacent posts and that these opposed paris of faces diverge outwardly so that the pieces or flakes of the cut product may flow more freely through the discharge opening as compared, for example, to the openings provided in the cutter heads disclosed in the Patents alluded to above.

More particularly, the tapered surfaces of the bars or partitions serve to provide relief or clearance for the cut pieces flowing outwardly through the discharge openings, and thereby substantially prevent, reduce or materially minimize frictional engagement of the pieces against the bars and thereby reduce the heat factor, substantially prevent accumulation of any hard deposits on the bars, all of which contributes to provide a resultant product or pieces which are more uniform in size and shape, texture and also of a better color depending on the character or kind of product being cut.

After the cutter head is cast to provide the structure described, with the apertures 24 in the portions 23, the upper surface of the upper portion 19 of the head is machined or finished and the lower surface of the lower portion 21 and upper surfaces of the portions 23 are also machined or finished. After these operations are preformed the inner pointed portions 30 of the posts 27 are machined, sharpened or finished to provide the sharp longitudinal cutting edges 14.

In view of the foregoing, it may be stated that each of the discharge openings is defined by four surfaces or faces and that the openings are generally trapezoidal in cross-dimensions which progressively increase outwardly, the purpose of which is to achieve the objects of the invention as set forth above, which among other things, is to provide a unique organization whereby to prevent or substantially minimize crushing, smearing, and excessive heating of the product while it is being cut, as distinguished from other machines in which the cut product is extruded through discharge openings. The important factor is that the head is made in such a way as to present the least amount of surface to the product being cut and therefore reduces friction. These advantages produce a cut product which is more uniform and clean cut and less motor power is required to produce the cut product since the factor of friction during the cutting process is materially reduced.

Attention is directed to the important fact that the cutter heads are constructed of a material or materials which impart appropriate hardness, abrasive resistance and impact resistance thereto in order that the heads will stand up during long periods of hard usage. For example, the head is so hard that the cutting edges cannot be machined by ordinary lathe tools but are sharpened by abrasive or grinding equipment.

In addition to the foreging it is to be understood that the bars or partitions in certain longitudinal rows thereof may be staggered with respect to the bars in other rows. In other words, the bars in a first pair of adjacent rows may be in the same plane and the bars in a second pair of rows may be disposed in a common plane parallel to the plane of the first pair or this may be setup on an alternate row basis.

OPERATION

As to the operation, the product is directed from one cutting edge to the other by the impeller blades. As the product inside the head leaves a cutting edge, it moves a very short distance over the inner surface and after leaving this surface, it continues to move on a tangent line so that the product does not contact the relief surface. The product then impacts against the surface which is the inside surface of the bars. Because of the impact force, a portion of the product will bulge into the discharge openings or spaces between the bars, and the bulged portions are cut into flakes or pieces by the next cutting edge and this action is repeated. Because hard meat gristle will not bulge into the spaces as much as the soft red meat, the gristle will cut into thinner pieces than the red meat.

The angle of the cutting edge is defined by the intersection of the surfaces and it is preferable that this angle be within a range of between 25° and 45°. For meat products which may contain considerable amounts of bone, such as with meat used for dog food, and where the bone can damage a slim edge knife angle, the edge should be close to 45°. When no bone is encountered, this edge may want to be close to 25° so as to achieve a cleaner cut with reduced crushing of the meat tissue.

The general class of products cut with the machine are cheese, meat, textured protein and animal hides. Because of the clean cutting action, the equipment is used almost universally by pharmacuetical houses for the cutting of animal gland into flakes for solvent extraction of drugs. One example of this is the extraction of insulin from the pancreas of cattle and pigs.

There are other advantages in using the equipment on meat. When the meat is cut into thin flakes without crushing of the tissue, and then when the flakes are pressed together to form a steak, the cooked product has more of the flavor of a steak than it does the flavor of a hamburger. Also, under these conditions, the flakes tend to interlock with each other so that the resulting product clings together better and does not fall apart as does hamburger which tends to crumble because of the pellet shape of the pieces of meat in hamburger. Because these pressed flakes cling together so well, it is possible to cut the product into cubes that do not fall apart, and these cubes are then used in stews and other meat products. Since meat trimmings can be used for the making of these cubes, the meat is upgraded and made more useful. The gristle in the meat is cut into much thinner flakes than is the red meat. This overcomes the objection found in hamburger which may contain hard pellets of gristle.

MODIFICATION

Figure 6:
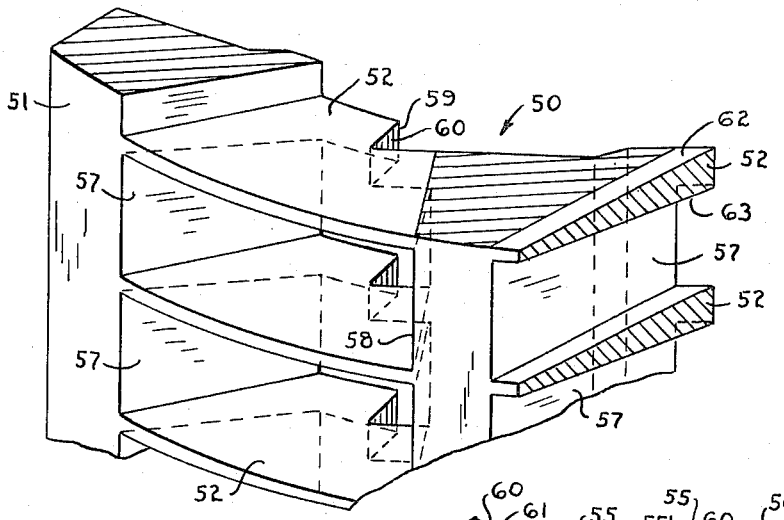
FIG. 6 is a partial perspective view of a modified form of cutter head.
Figure 7:
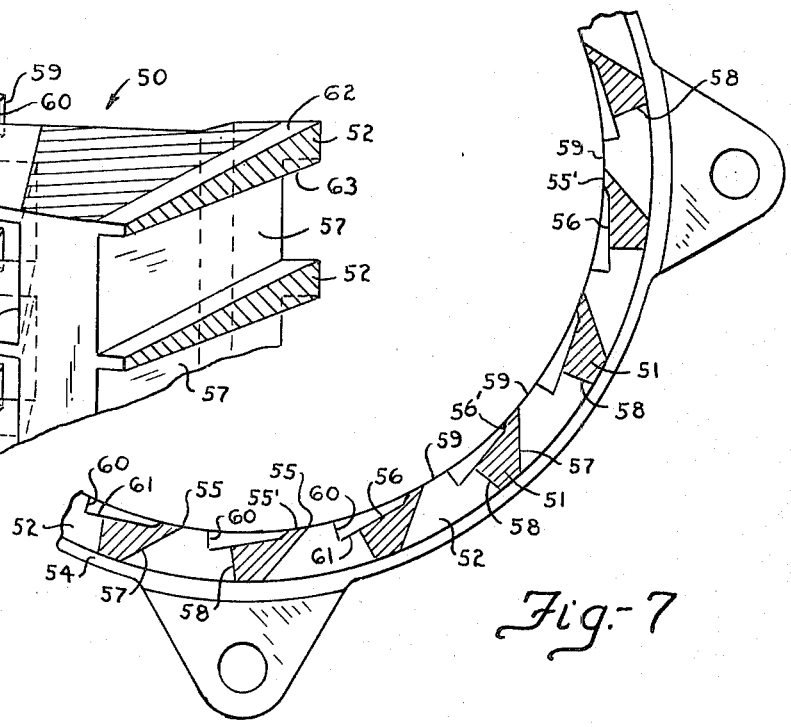
FIG. 7 is a partial horizontal sectional view of the structure shown in FIG. 6.
Figure 8:
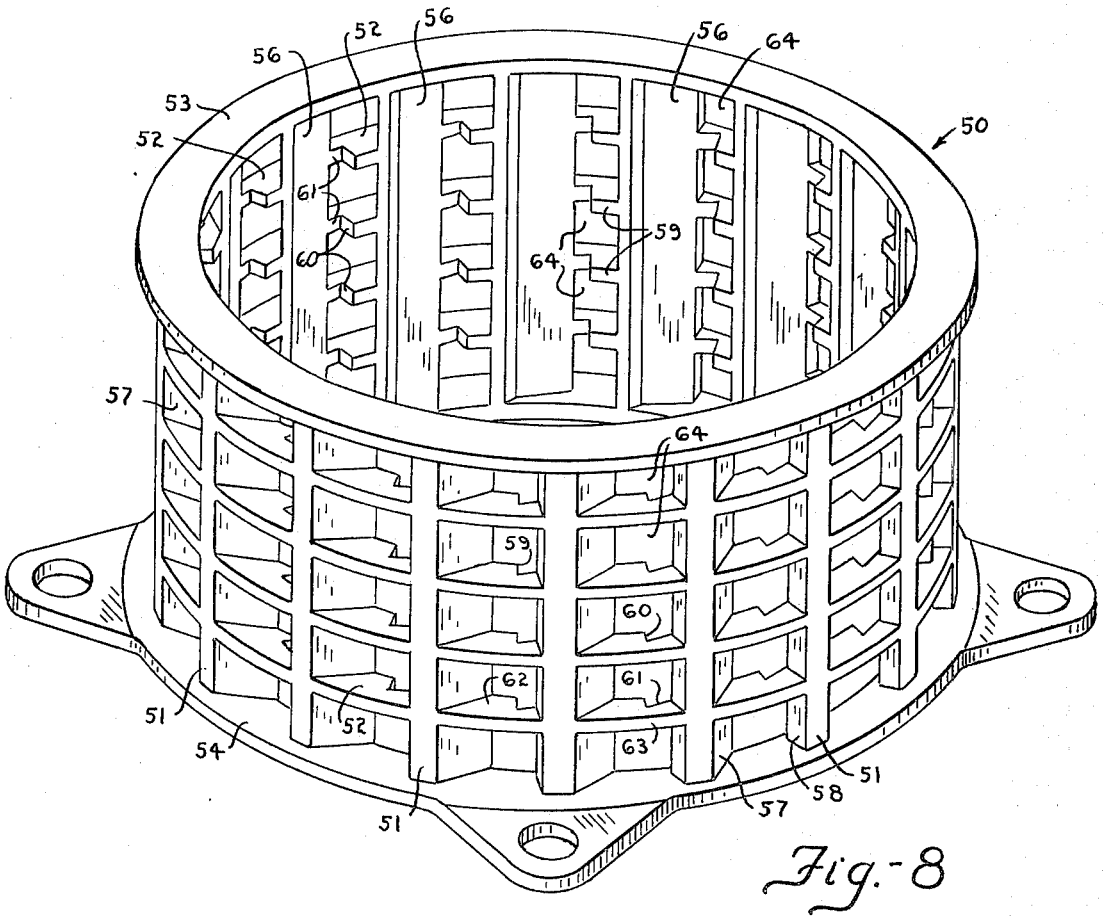
FIG. 8 is a pictorial view of the modified cutter head.

Referring now to FIGS. 6, 7 and 8 there is disclosed a modified form of a cutter head generally designated 50. The design and construction of this head generally corresponds to that of the head described above, but primarily differs therefrom by providing bars or partitions which are preferably provided with means which may be referred to as interruptions, abutments or notches.

More particularly, the head 50 is comprised of circumferentially spaced longitudinally extending posts or columns 51, longitudinally spaced circumferentially extending bars or partitions 52 and upper and lower annular portions 53 and 54. Each of the posts, among other things, is generally trapezoidal in cross-section and has a sharpened inner portion 55 pointed in a direction opposite to that of an impellers rotation, an inner relief or tangential surface 56, and a pair of side surfaces or faces 57 and 58. The pointed portion 55 has an inner machined surface or lane 55' and a relief surface 56' adjoined to the relief surface 56.

Each of the bars or partitions 52 has an inner arcuate edge portion 59 and an interruption or notch defined by surfaces 60 and 61, the latter of which constitutes a continuation of the relief surface 56 of a post as evidenced in FIG. 7. Each of the bars also has a pair of tapered surfaces 62 and 63 which generally converge outwardly as shown in FIGS. 6 and 8. The opposed surfaces of adjacent posts and the opposed surface of adjacent bars define discharge openings 64 substantially corresponding to the openings 29 in the cutter head 10 described above.

The cutter head 50 serves to size reduce products that do not deform easily, such as, for example, licorice root, lobster shell and dill weed. The head 50 is also especially useful with respect to size reducing meat to produce pet foods that contain considerable amounts of bone and hard cartilage. The interruptions or notches saw, rip and tear hard materials to permit these materials to reach the cutting edges and thereby be successfully cut and ejected form the head. As the material or product leaves the small inner lands 55' or surfaces, it moves in the paths of a tangent and does not touch or slide against the relief surfaces 56 of the posts. The interruptions, notches or teeth cut grooves in the material and the depth of the grooves determines the thickness of the slices or flakes to be cut by the knives or cutting edges. The material slides short distances over the inner arcuate faces or surfaces 59 of the bars before being cut. There are at least two significant reasons for designing and constructing the bars as described. One reason, is that when cutting material containing hard portions such as bone in meat, it is desirable that the hard bone initially strike the notches before engaging the cutting edges and thereby protects these edges. The bars also assist in supporting and strengthening the cutting or knife edges. The second reason is that when the material to be cut contains considerable fiber, some of the fiber will fold over the notches or saw teeth and partially close the discharge openings. By locating the saw teeth a distance back of the cutting edges, any fiber folding over the teeth will not obstruct the discharge openings in the vicinity of the cutting edges.

Having thus described my invention, it is obvious that various modifications may be made in the same without departing from the spirit of the invention and therefore, I do not wish to be understood as limiting myself to the exact forms, constructions, arrangements and combinations of the components herein shown, described and claimed.

I claim:

1. A method of cutting a product in a cylindrical cutter head provided with a plurality of discharge openings separated longitudinally by circumferentially extending partitions having inner abutments and outwardly extending generally converging surfaces and the head has cutting edges adjacent the openings, which comprises rotating the product in the head so that the abutments form grooves in the product and the cutting edges subsequently cut the grooved portions of the product into pieces for flow through the openings in a manner whereby the pieces substantially avoid said converging surfaces.

2. A method of cutting a product in a cylindrical cutter head provided with inner cutting edges and with a plurality of outwardly extending discharge openings having pairs of opposed upper and lower surfaces and pairs of opposed side surfaces which diverge outwardly, which comprises rotating a product in the head so that the cutting edges cut the product into pieces for flow outwardly through the openings in a manner whereby the pieces substantially avoid engaging said upper and lower surfaces.

3. The method defined in claim 2, in which the pieces avoid the upper and lower surfaces and side surfaces of the majority of the openings.

4. A tubular cylindrical cutter head having wall structure provided with circumferentially spaced longitudinally extending posts provided with cutting edges, and circumferentially spaced bars joining said posts and dividing said spaces into rows of longitudinally spaced discharge openings, and said bars having outwardly extending surfaces which generally converge a sufficient extent so that a product upon being rotated in the head against the cutting edges will be cut into pieces for flow outwardly through the openings whereby to substantially avoid said surfaces.

5. The cutter head defined in claim 4, in which said bars have inner edges which are provided with interruptions for forming grooves in portions of the product prior to cutting these portions into pieces.

6. The cutter head defined in claim 4, in which the head is of a one-piece construction.

7. A cylindrical tubular cutter head for use with an impeller for cutting a product into pieces, said head comprising a plurality of circumferentially spaced longitudinally extending parallel posts provided with opposed surfaces and with longitudinally extending cutting edges, a plurality of longitudinally spaced circumferentially extending bars joining said posts and provided with faces, said surfaces of said posts and said faces of said bars forming in combination tunnel-like openings which taper outwardly through which the pieces of the product are adapted to be discharged, and said head being adapted for attachment to a supporting means.

8. A cylindrical tubular cutter head for use with an impeller for cutting a product into pieces, said head comprising a plurality of circumferentially spaced longitudinally extending parallel posts provided with cutting edges, and a plurality of longitudinally spaced circumferentially extending bars joined to said posts and forming in combination therewith channel-like discharge openings for the pieces cut by the cutting edges, said bars also extending outwardly and having inner portions which have a greater cross-sectional dimension than outer portions thereof.

9. The cutter head defined in claim 8, in which said posts and said bars have inner surfaces which define obtuse angles.

10. A tubular cylindrical cutter head for use with an impeller adapted for rotation therein, said head having wall structure provided with circumferentially spaced longitudinally extending rows of spaced discharge openings which are separated longitudinally by substantially parallel bars, said wall structure also being provided with inner cutting edges located adjacent to said openings, said bars having inner portions which have cross-dimensions which are greater than outer portions thereof, and said head having ends which are constructed to facilitate attachment of the head to a mounting means.

11. The cutter head defined in claim 10, in which said inner portions of said bars are angularly disposed with reference to the longitudinal axis of said head.

12. A tubular cylindrical cutter head for use with an impeller, said head having wall structure provided with outwardly extending opposed pairs of surfaces defining openings which are longitudinally and circumferentially spaced and said structure has longitudinal cutting edges which are located on the inner side of the wall structure adjacent said openings, each pair of opposed surfaces being disposed in a diverging relation, and said head having ends provided with means to facilitate attachment of the head to supporting means.

13. A tubular cylindrical cutter head for use with an impeller adapted for rotation therein, said head having wall structure provided with a plurality of circumferentially spaced longitudinally extending openings divided into discharge openings by circumferentially extending longitudinally spaced bars, said wall structure also being provided with inner longitudinally extending cutting edges located adjacent to said discharge openings, and said bars having inner portions located at the inner side of said wall structure and also with outer portions which have a cross-dimension less than that of said inner portions.

14. A tubular cylindrical cutter head for use with an impeller, said head having wall structure provided with outwardly extending opposed pairs of upper and lower surfaces and opposed pairs of side surfaces defining openings which are longitudinally and circumferentially spaced and said structure has longitudinal cutting edges which are located on the inner side of the wall structure adjacent said openings, and at least one of said openings having said upper and lower surfaces being disposed in a diverging relation.

15. The cutter head defined in claim 14, in which the majority of the openings are provided with such surfaces.

16. In combination: a tubular cylindrical cutter head and an impeller having lead surfaces, said head having wall structure provided with outwardly extending opposed pairs of upper and lower surfaces and side surfaces defining openings which are longitudinally and circumferentially spaced and said structure has cutting edges which are located on the inner side of the wall structure adjacent said openings, and said pairs of opposed upper and lower surfaces of each opening being disposed in a diverging relation so that when the impeller is rotated its lead surfaces may be caused to rotate a product against said cutting edges to cut it into pieces for flow outwardly through said openings whereby to substantially avoid these divergent surfaces.

17. The combination defined in claim 16, in which said wall structure is also provided with angularly disposed inner surfaces affording clearance for the cutting edges.

* * * * *